US008053995B2

(12) United States Patent
Chang et al.

(10) Patent No.: US 8,053,995 B2
(45) Date of Patent: Nov. 8, 2011

(54) LED LIGHT STRING WITHOUT ADDITIONAL RESISTORS

(76) Inventors: Chu-Cheng Chang, Hsinchu (TW); Cheng-Fen Chang, Hsinchu (TW); Chen-Hsien Chang, Hsinchu (TW); Chen-Tao Chang, Hsinchu (TW)

( * ) Notice: Subject to any disclaimer, the term of this patent is extended or adjusted under 35 U.S.C. 154(b) by 522 days.

(21) Appl. No.: 12/242,169

(22) Filed: Sep. 30, 2008

(65) Prior Publication Data

US 2010/0079076 A1 Apr. 1, 2010

(51) Int. Cl.

| | |
|---|---|
| ***H05B 37/00*** | (2006.01) |
| ***H05B 39/00*** | (2006.01) |
| ***H05B 41/00*** | (2006.01) |
| *H05B 41/14* | (2006.01) |
| *F21S 4/00* | (2006.01) |

(52) U.S. Cl. ..... 315/185 R; 315/185 S; 315/201; 315/312

(58) Field of Classification Search ..... 315/185 S, 315/187

See application file for complete search history.

(56) References Cited

U.S. PATENT DOCUMENTS

| | | | | |
|---|---|---|---|---|
| 6,448,900 | B1 * | 9/2002 | Chen | 340/815.45 |
| 2007/0236443 | A1 * | 10/2007 | Lee | 345/102 |
| 2009/0159677 | A1 * | 6/2009 | Yakimov et al. | 235/439 |

FOREIGN PATENT DOCUMENTS

CN 101247043 A * 8/2008

* cited by examiner

*Primary Examiner* — Douglas W Owens
*Assistant Examiner* — Dedei K Hammond

(57) ABSTRACT

An electrical circuit for use as a string of lights in one embodiment includes a rectifier for converting AC into DC; and a plurality of lamps connected in series, each lamp having an LED, and wherein at least one of the lamps each has a Zener diode connected in series with the LED, a positive terminal of the lamp proximate the rectifier is connected to a positive terminal of an output of the rectifier, and a negative terminal of the lamp distal the rectifier is connected to a negative terminal of the output of the rectifier. In another embodiment, the Zener diode is replaced with a resistor. Hence, no resistors are provided externally of the lamp.

1 Claim, 24 Drawing Sheets

LED LIGHT STRING WITHOUT ADDITIONAL RESISTORS

BACKGROUND OF THE INVENTION

1. Field of Invention

The invention relates to providing electrical power to a plurality of low voltage electrical loads, and more particularly to a string of LED (light-emitting diode) light having a plurality of lamps wired in series, each lamp having an LED and some or all lamps having an additional one of a Zener diode and a resistor connected in series with the LED, thereby eliminating the provision of any additional resistors externally of the lamp.

2. Description of Related Art

LEDs are renowned for their long life and their ability to resist shock. Also, an LED consumes much less electrical power than fluorescent lamps (i.e., energy saving). Therefore, LED lighting devices are gaining popularity worldwide.

A conventional string of lights including a plurality of LED bulbs arranged electrically in a series circuit is shown in FIGS. 1 and 2. AC 120V is rectified by a full-wave rectifier (not shown) to convert into DC (e.g., DC 120V) to be consumed by the plurality of LED bulbs. Each LED bulb is wired in series with a resistor 1. For example, the LED bulb is a blue LED bulb of 3.2V 0.02A. The number of the blue LED bulbs is 25. The light string has a nominal operating voltage of DC 80V. The light string will be damaged if DC 120V is directly applied thereto without any voltage reduction. Resistance (R) of additional resistor(s) other than the LED bulbs of the light string is equal to 40V (i.e., 120V−80V) divided by 0.02 A according to Ohm's Law. Hence, the resistance (R) is 2,000 Ω. Resistor is an electrical component that may generate much heat when energized. 40V power may be applied to a single resistor of 2,000 Ω inserted in series with one of the LED bulbs. Disadvantageously excessive heat generated by the resistor will burn out the LED bulb, thereby killing the circuit. Hence, it is typical to arrange five resistors 1 of 400 Ω each to connect in series to one LED bulb, i.e., five connected LED bulbs in total. Each resistor 1 has a voltage component of 8V and is adapted to generate much less heat. Therefore, the light string is protected.

Another conventional string of lights including a plurality of LED bulbs arranged electrically in a series circuit is shown in FIGS. 3 and 4. AC 120V is rectified by a full-wave rectifier in a plug (not shown) to convert into DC (e.g., DC 120V) which is to be consumed by the plurality of LED bulbs. A resistor 1 is interconnected to the rectifier output and the adjacent LED bulb (i.e., the load). For example, the LED bulb is a blue LED bulb of 3.0V 0.02 A. The number of the blue LED bulbs is 30. The light string has a nominal operating voltage of DC 90V. The light string will be damaged if DC 120V is directly applied thereto without any voltage reduction. Resistance (R) of the additional resistor 1 other than the LED bulbs of the light string is equal to 30V (i.e., 120V−90V) divided by 0.02 A according to Ohm's Law. Hence, the resistance (R) of the resistor 1 is 1,500 Ω. DC 30V is applied to the resistor 1. Also, the resistor 1 is adapted to generate much less heat. Therefore, the light string is protected.

However, both the well known light strings suffer from a number of disadvantages. In detail, each resistor is required to dispose in the light string by soldering which may pollute the environment if sufficient care is not taken. LED bulbs may be damaged due to high temperature and electrostatic discharge (ESD) while soldering. Soldering is a manual, laborious task such that these light strings cannot be mass produced easily.

Heat generated by the resistor may damage the adjacent LED bulb and even cause a fire hazard. Moreover, the manufacturing cost is very high.

There have been numerous suggestions in prior patents for light string. For example, U.S. Pat. No. 6,344,716 discloses a Christmas light string. Thus, continuing improvements in the exploitation of light string employing LED bulbs are constantly being sought.

SUMMARY OF THE INVENTION

It is therefore one object of the invention to provide a string of LED light having a plurality of lamps wired in series, each lamp having an LED and some or all lamps having an additional one of a Zener diode and a resistor connected in series with the LED, thereby eliminating the provision of any additional resistors externally of the lamp.

The above and other objects, features and advantages of the invention will become apparent from the following detailed description taken with the accompanying drawings.

DETAILED DESCRIPTION OF THE INVENTION

Figure 1:
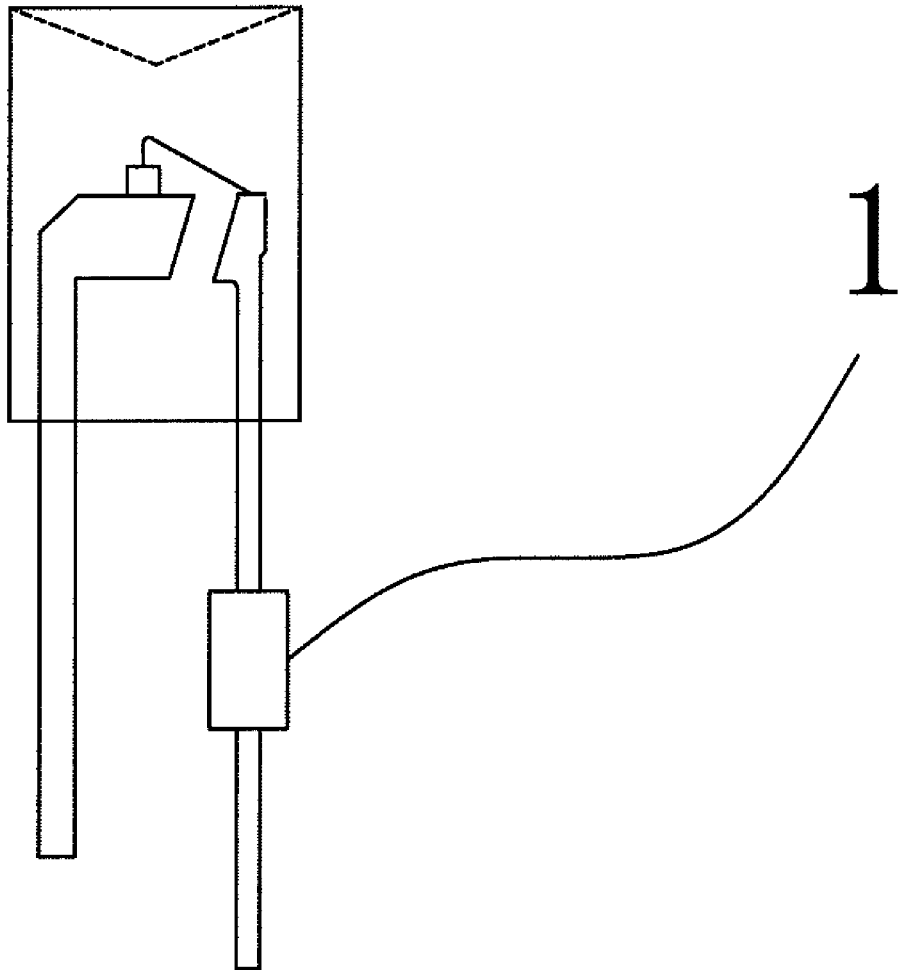
Fig. 1 PRIOR ART
FIG. 1 schematically shows an LED bulb of a conventional LED light string with an additional resistor connected in series to the LED bulb.
Figure 2:
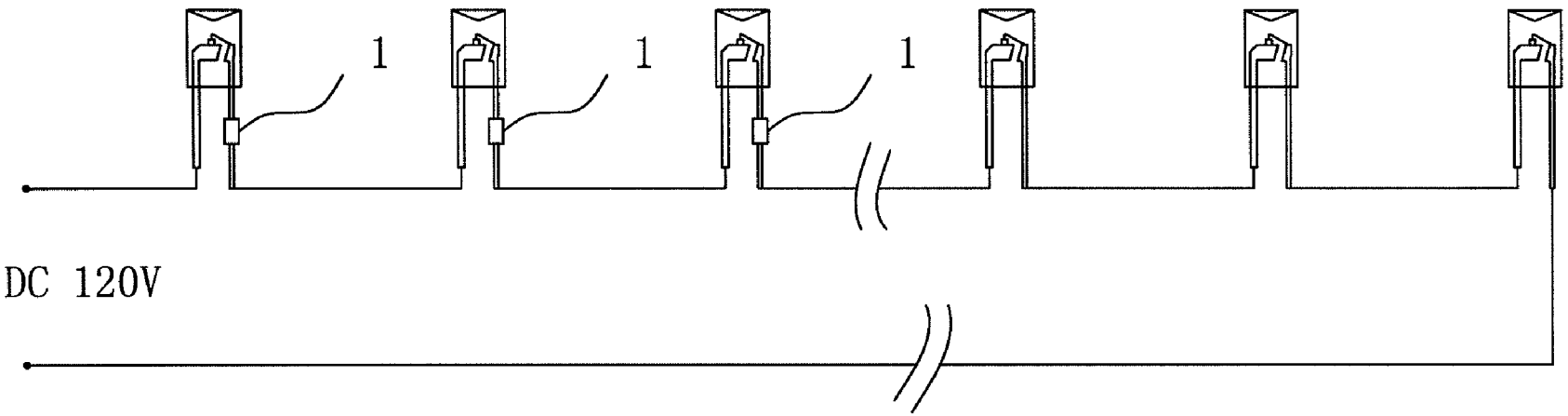
Fig. 2 PRIOR ART
FIG. 2 schematically shows the conventional LED light string of FIG. 1.
Figure 3:
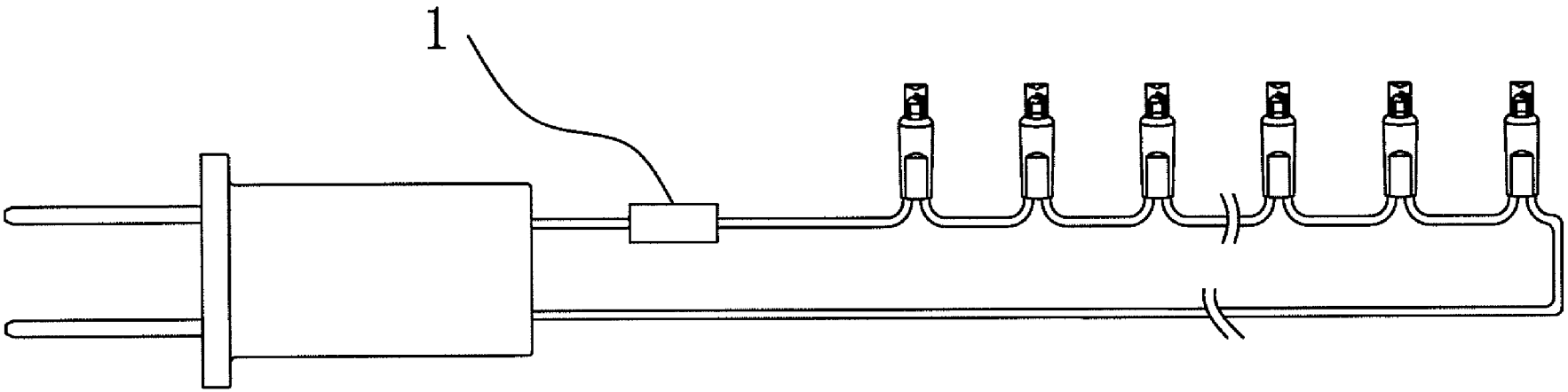
Fig. 3 PRIOR ART
FIG. 3 schematically shows another conventional LED light string with an additional resistor interconnected to the rectifier output and the adjacent LED bulb of the light string.
Figure 4:
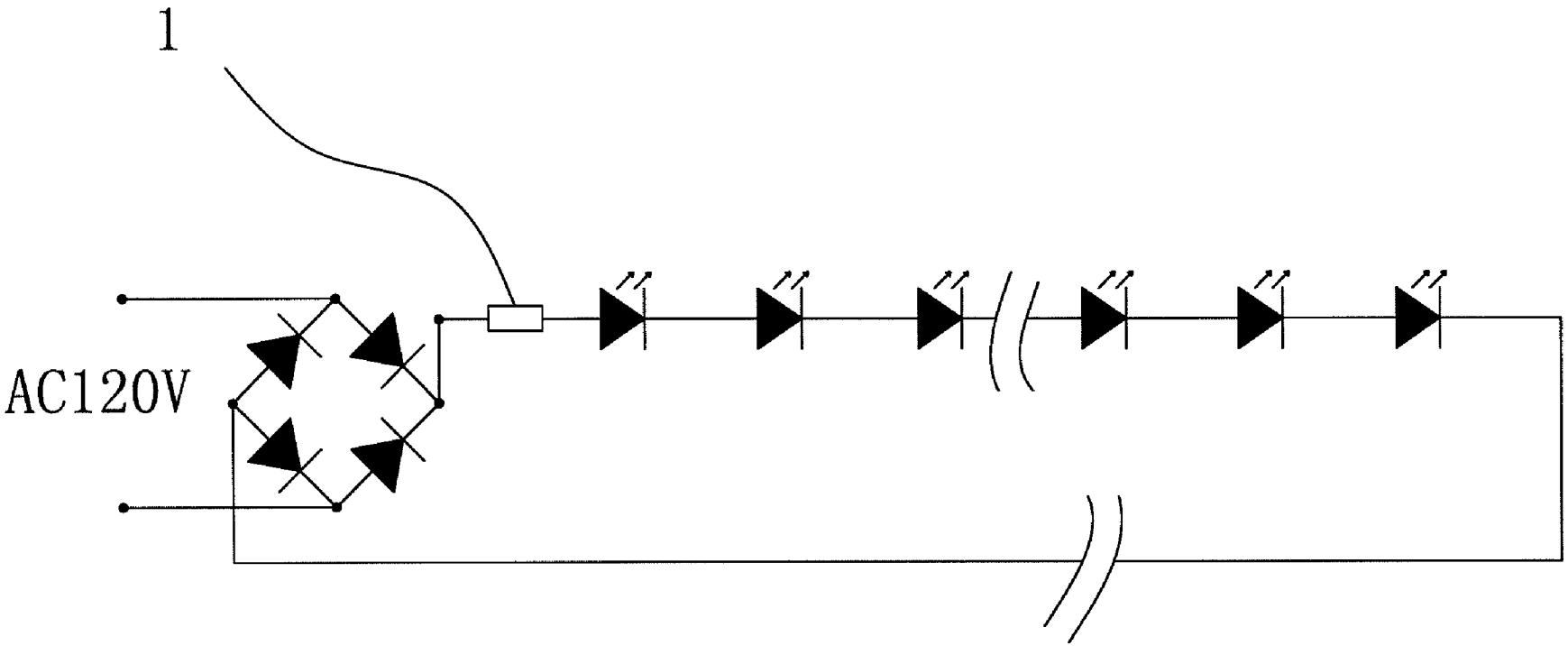
Fig. 4 PRIOR ART
FIG. 4 is a circuit diagram of the light string of FIG. 3.
Figure 5:
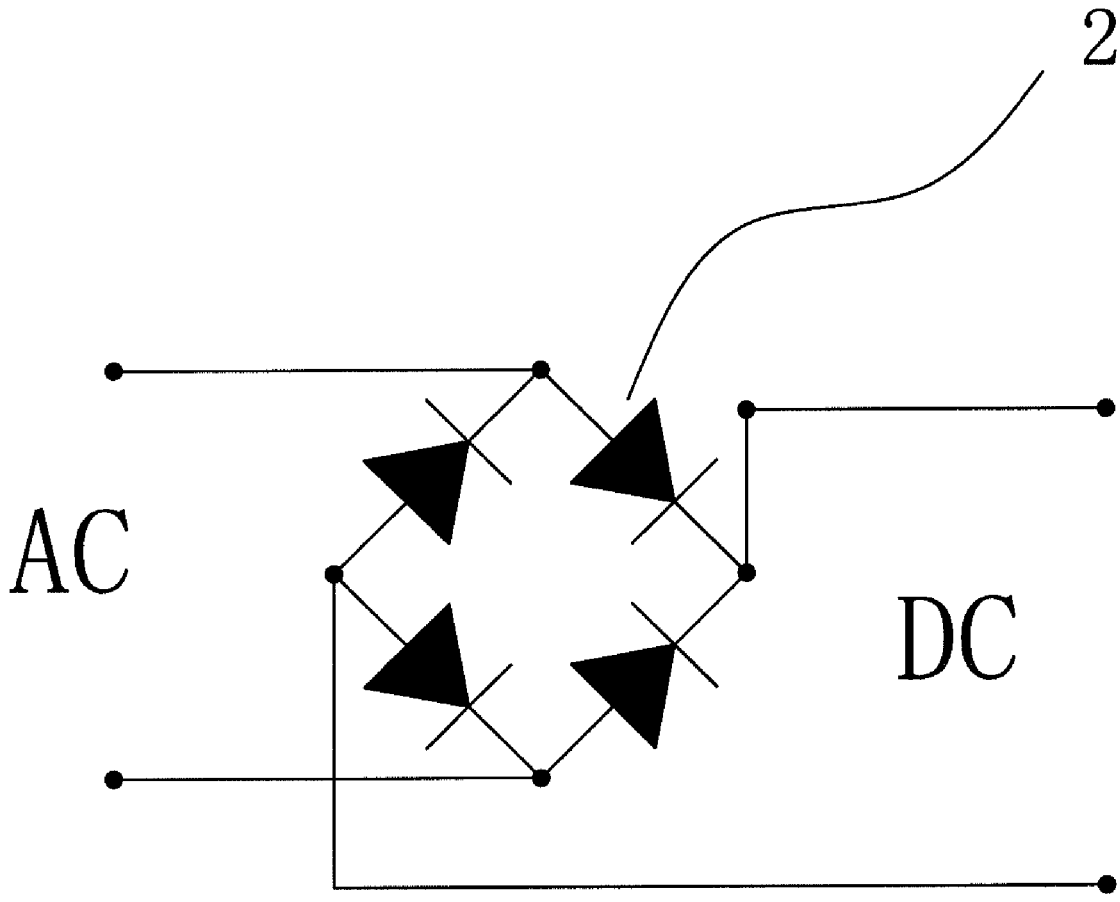
FIG. 5 is a circuit diagram of a first preferred embodiment of rectifier according to the invention to be used in an LED light string of the invention.

Referring to FIG. 5, it shows a circuit diagram of a first preferred embodiment of rectifier 2 according to the invention to be used in an LED light string of the invention. The rectifier 2 is implemented as a full-wave rectifier (e.g., bridge rectifier) and is adapted to convert an AC power source (e.g., AC 120V) into DC current.

Figure 6:
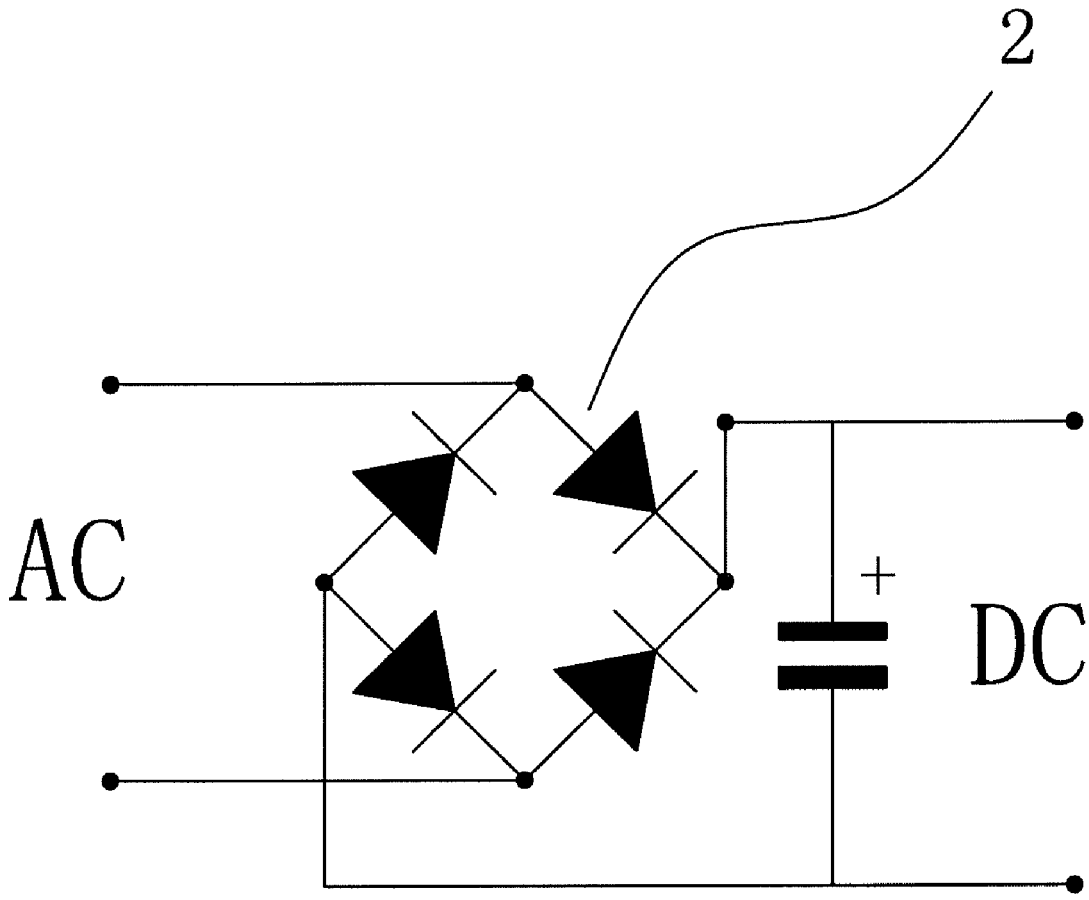
FIG. 6 is a circuit diagram of a second preferred embodiment of rectifier according to the invention to be used in an LED light string of the invention.

Referring to FIG. 6, it shows a second preferred embodiment of rectifier 2 according to the invention to be used in an LED light string of the invention. The rectifier 2 is also a bridge rectifier having a capacitor filter being inserted in parallel with the load (not shown). Hence, the output voltage is smoothed by the action of the capacitor as well known in the art.

Figure 7:
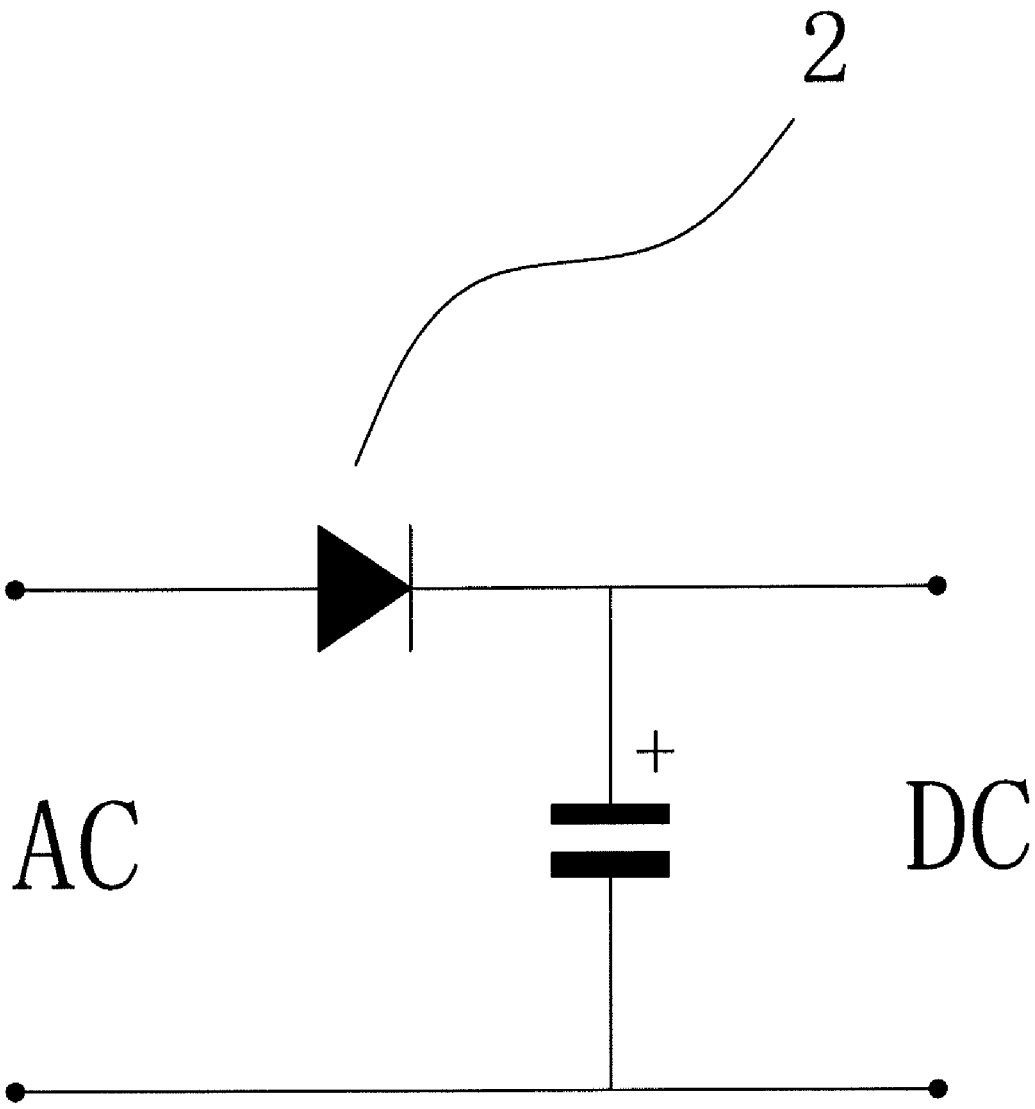
FIG. 7 is a circuit diagram of a third preferred embodiment of rectifier according to the invention to be used in an LED light string of the invention.

Referring to FIG. 7, it shows a third preferred embodiment of rectifier 2 according to the invention to be used in an LED light string of the invention. The rectifier (e.g., a diode) 2 is implemented as a half-wave rectifier having a capacitor filter being inserted in parallel with the load (not shown). Hence, the output voltage is smoothed by the action of the capacitor as well known in the art.

Figure 8:
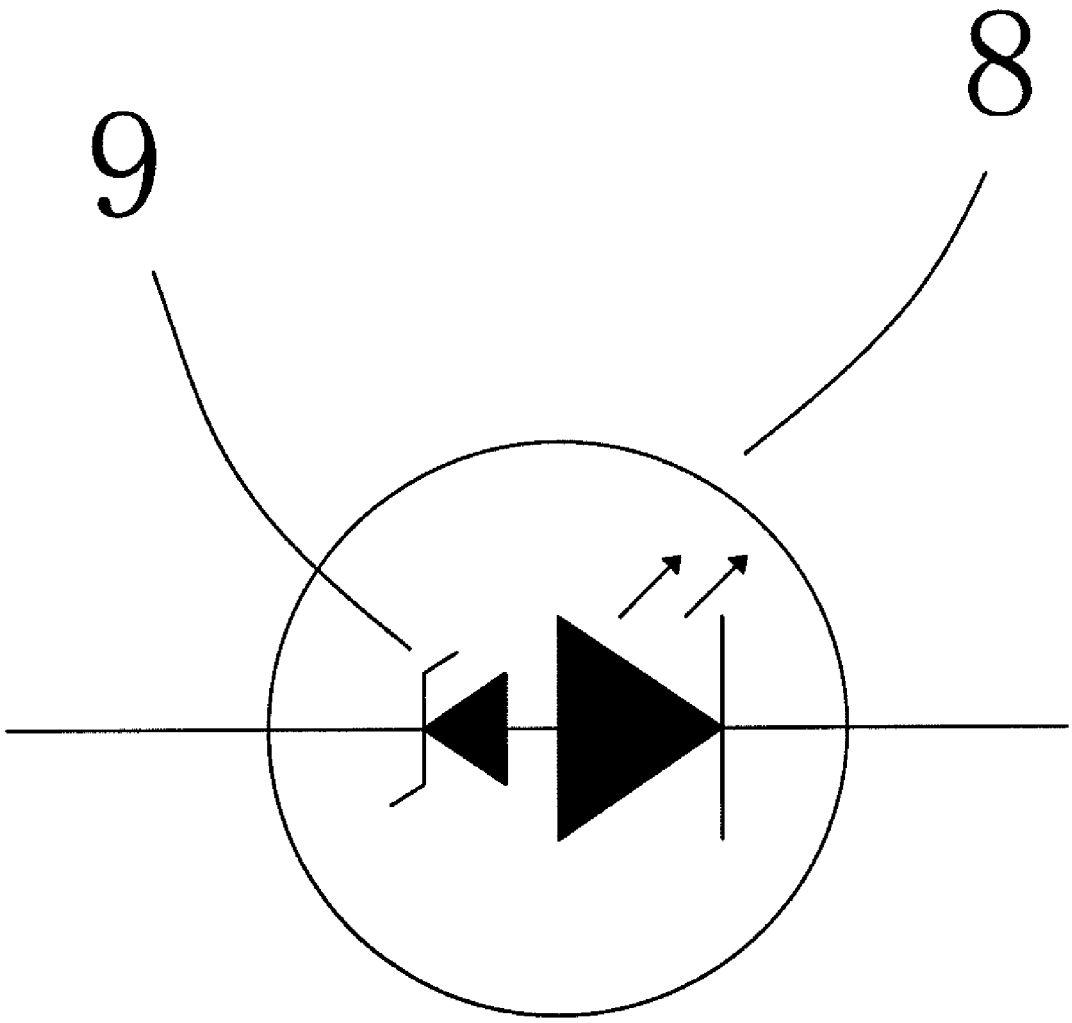
FIG. 8 is a circuit diagram of a first preferred embodiment of LED bulb according to the invention to be used in an LED light string of the invention.

Referring to FIG. 8, it is a circuit diagram of a first preferred embodiment of LED bulb 8 according to the invention to be used in an LED light string of the invention. The LED bulb 8 comprises a Zener diode 9 and an LED (not numbered) having a positive electrode (i.e., anode) connected to a positive electrode (i.e., anode) of the Zener diode 9. Negative electrode (i.e., cathode) of the Zener diode 9 is positive terminal of the LED bulb 8 and negative electrode (i.e., cathode) of the LED is negative terminal of the LED bulb 8 respectively.

For example, the Zener diode 9 has a Zener voltage (i.e., reverse breakdown voltage) of 9V, the LED has a forward voltage of 3V, and current flowing through both the LED and the Zener diode 9 is 0.02 A prior to avalanche breakdown of the Zener diode 9. Hence, the operating voltage of the LED bulb 8 is 12V (i.e., 9V+3V). That is, the LED bulb 8 may light by applying DC 12V thereto.

Figure 9:
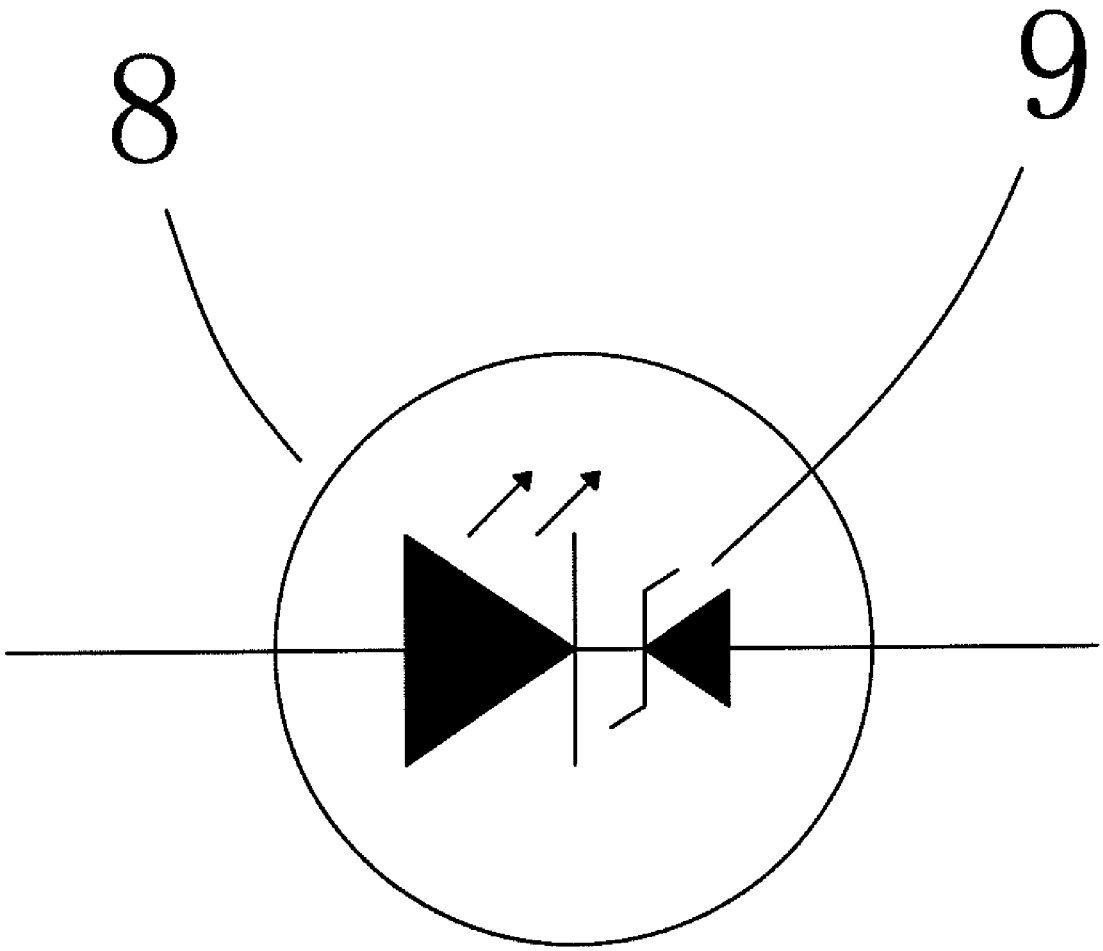
FIG. 9 is a circuit diagram of a second preferred embodiment of LED bulb according to the invention to be used in an LED light string of the invention.

Referring to FIG. 9, it is a circuit diagram of a second preferred embodiment of LED bulb 8 according to the invention to be used in an LED light string of the invention. The LED bulb 8 comprises a Zener diode 9 and an LED (not numbered) having a negative electrode (i.e., cathode) connected to a negative electrode (i.e., cathode) of the Zener diode 9. Positive electrode (i.e., anode) of the Zener diode 9 is negative terminal of the LED bulb 8 and positive electrode (i.e., anode) of the LED is positive terminal of the LED bulb 8 respectively.

For example, the Zener diode 9 has a Zener voltage of 3V, the LED has a forward voltage of 2.2V, and current flowing through both the LED and the Zener diode 9 is 0.02 A prior to avalanche breakdown of the Zener diode 9. Hence, the operating voltage of the LED bulb 8 is 5.2V (i.e., 3V+2.2V). That is, the resistor 8 may light by applying DC 5.2V thereto.

Figure 10:
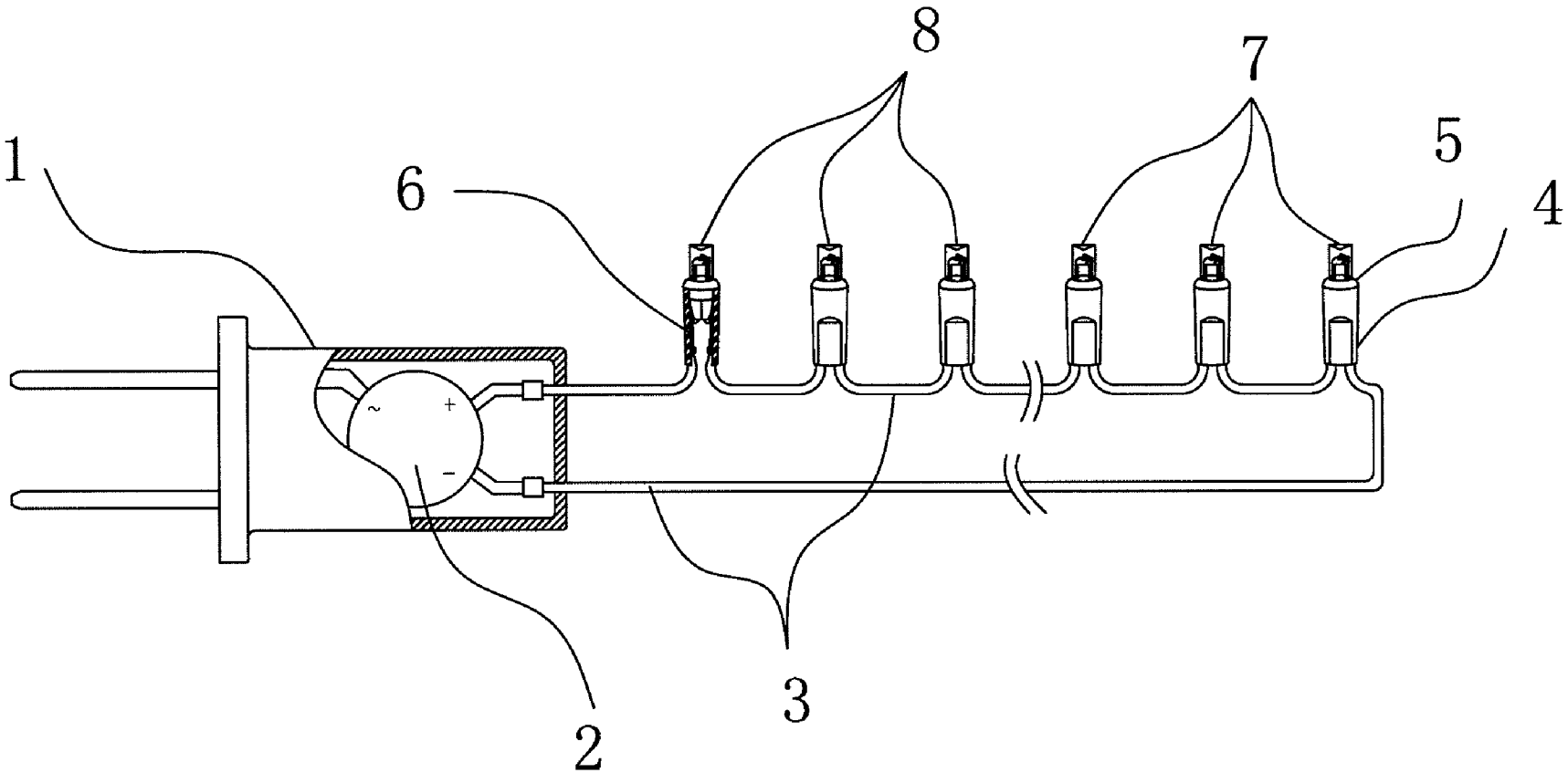
FIG. 10 schematically shows an LED light string of the invention.
Figure 14:
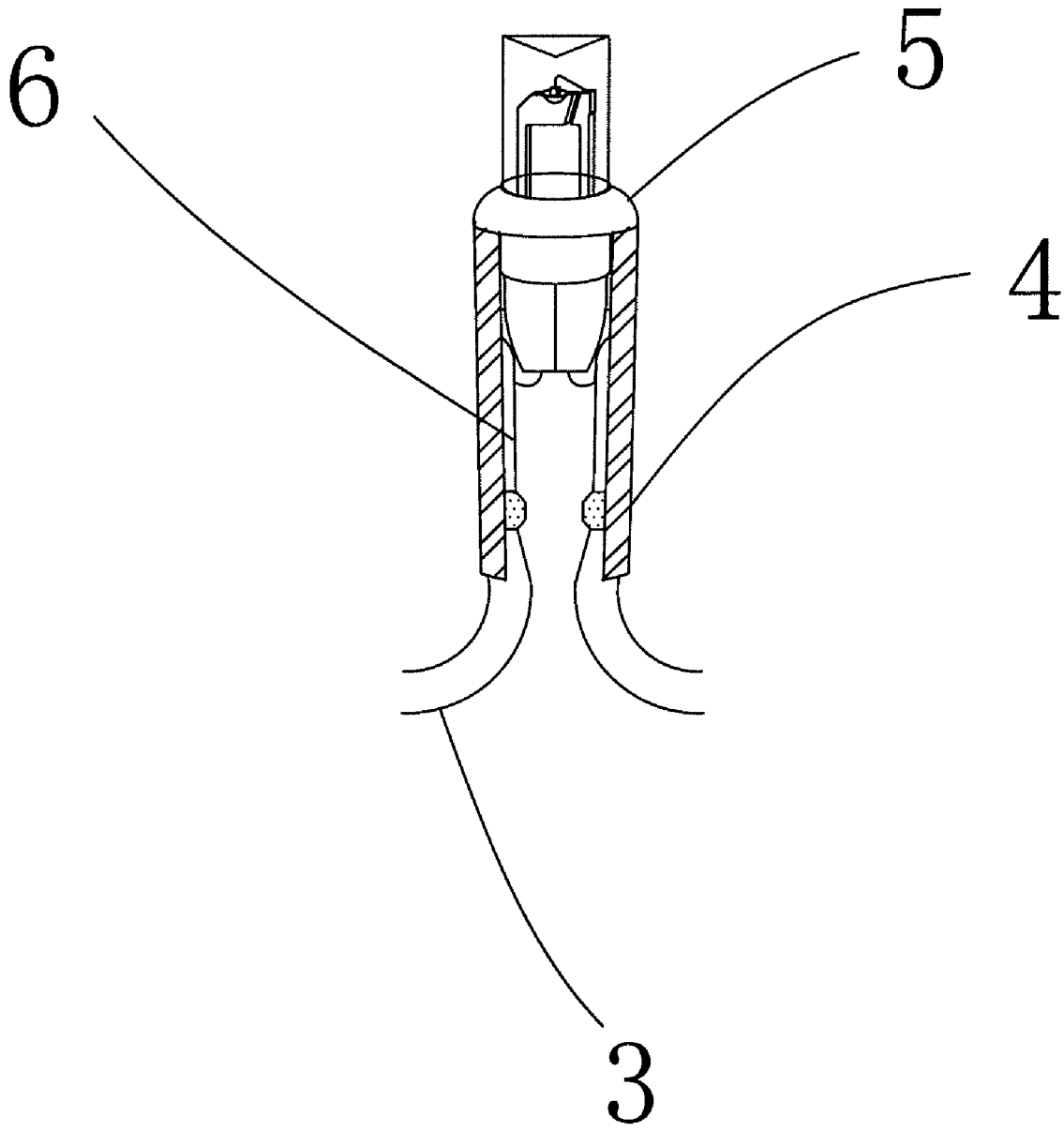
FIG. 14 is a perspective view in part section of the LED bulb of FIG. 10.

Referring to FIGS. 10 and 14, it shows an LED light string in accordance with the invention. The LED light string comprises a plug 1 having positive and negative prongs (not numbered), a rectifier 2 as any one shown above provided in the plug 1, and a plurality of typical LEDs 7 as one set and a plurality of LED bulbs 8 as the other set both sets being electrically connected together in series between positive terminal of the rectifier output and negative terminal thereof through a cord 3 to construct a complete circuit.

The LED bulb 8 comprises a first filament wire 6 connected to one end of a section of the cord 3, a second filament wire 6 connected to one end of another section of the cord 3, a cylindrical body 4 for storing LED, other electrical components, and the filament wire 6, and a cap 5 formed of flexible material with the LED projecting therefrom. Also, both the Zener diode 9 and the LED in the LED bulb 8 are electrically connected to the filament wires 6, or the LED 7 is electrically connected to the filament wires 6.

For example, the blue LED 7 is of 3.2V 0.02 A, the blue LED bulb 8 is of 11.2V 0.02 A the number of the blue LEDs 7 is 20, the number of the blue LED bulbs 8 is 5, AC power source is AC 120V and operating voltage of the light string is DC 120V. It is envisaged by the invention that the light string can operate normally by wiring as above.

Figure 11:
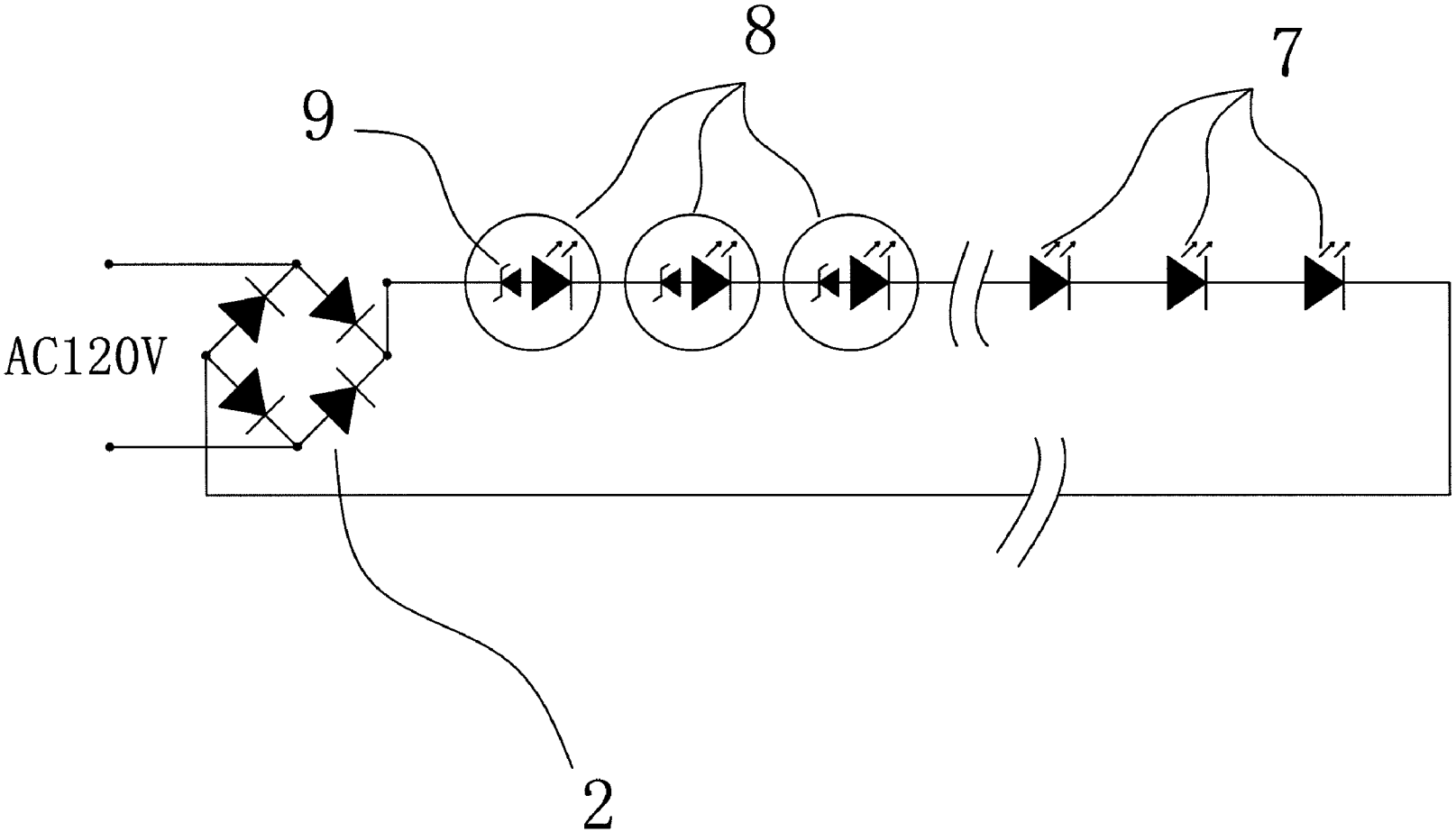
FIG. 11 is a circuit diagram of a first preferred embodiment of the LED light string of FIG. 10.

Referring to FIG. 11, it shows a circuit diagram of a first preferred embodiment of the LED light string of FIG. 10. The characteristics of the first preferred embodiment are detailed below. The rectifier 2 is a bridge rectifier as that shown in FIG. 5, the LED bulbs 8 are that shown in FIG. 8, the blue LED 7 is of 3.0V 0.02 A, the blue LED bulb 8 is of 13.0V 0.02 A, the number of the blue LEDs 7 is 27, the number of the blue LED bulbs 8 is 3, AC power source is AC 120V, and operating voltage of the light string is DC 120V. It is envisaged by the invention that the light string can operate normally by wiring as above.

Figure 12:
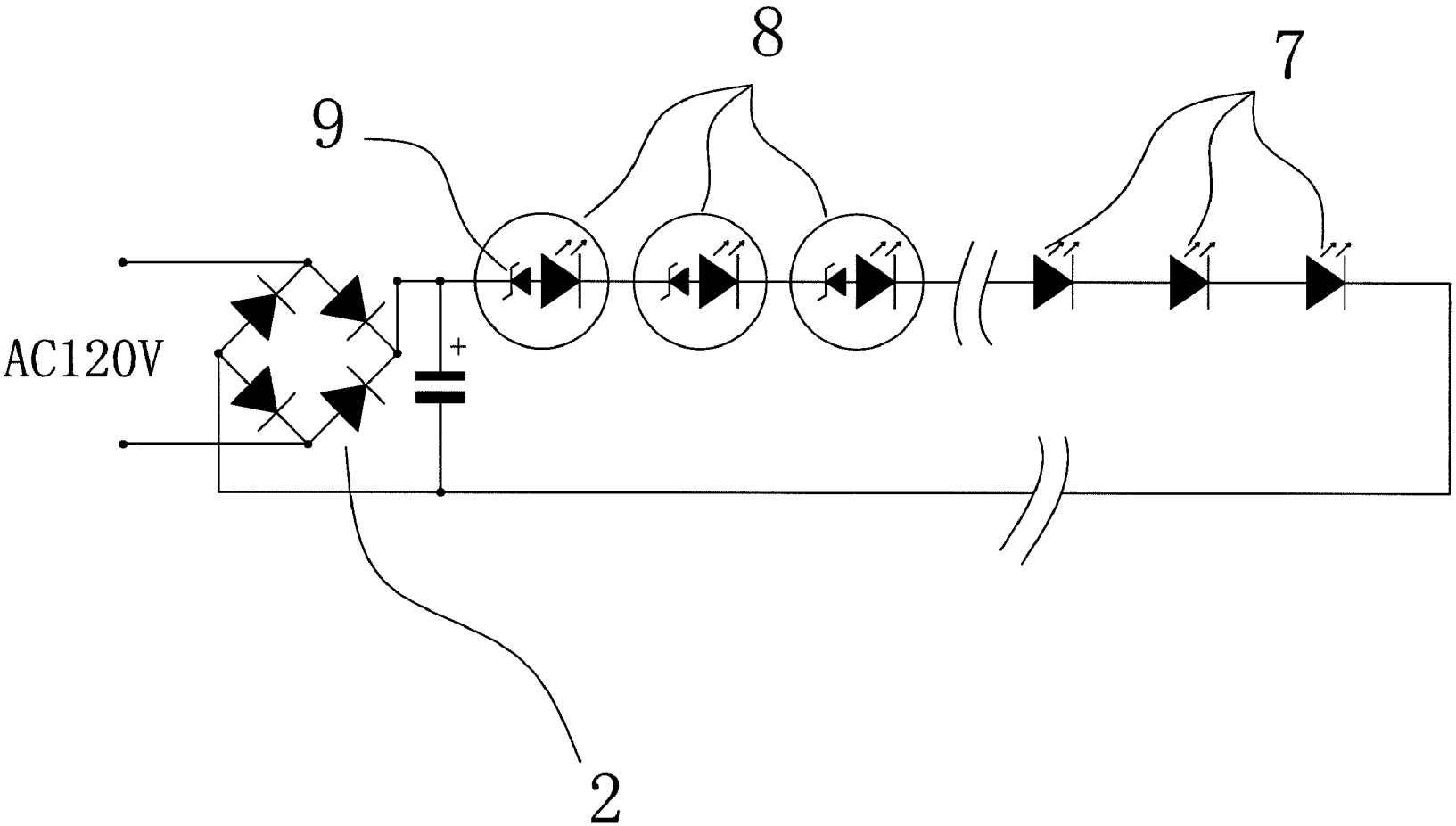
FIG. 12 is a circuit diagram of a second preferred embodiment of the LED light string of FIG. 10.

Referring to FIG. 12, it shows a circuit diagram of a second preferred embodiment of the LED light string of FIG. 10. The characteristics of the second preferred embodiment are detailed below. The rectifier 2 is a bridge rectifier having a capacitor parallel connected with the load (i.e., the LED bulbs 8 and the LEDs 7) as that shown in FIG. 6, the LED bulbs 8 are that shown in FIG. 8, the white LED 7 is of 3.0V 0.02 A, the white LED bulb 8 is of 13.0V 0.02 A, the number of the white LEDs 7 is 27, the number of the white LED bulbs 8 is 3, AC power source is AC 120V, and operating voltage of the light string is DC 120V. It is envisaged by the invention that the light string can operate normally by wiring as above.

Figure 13:
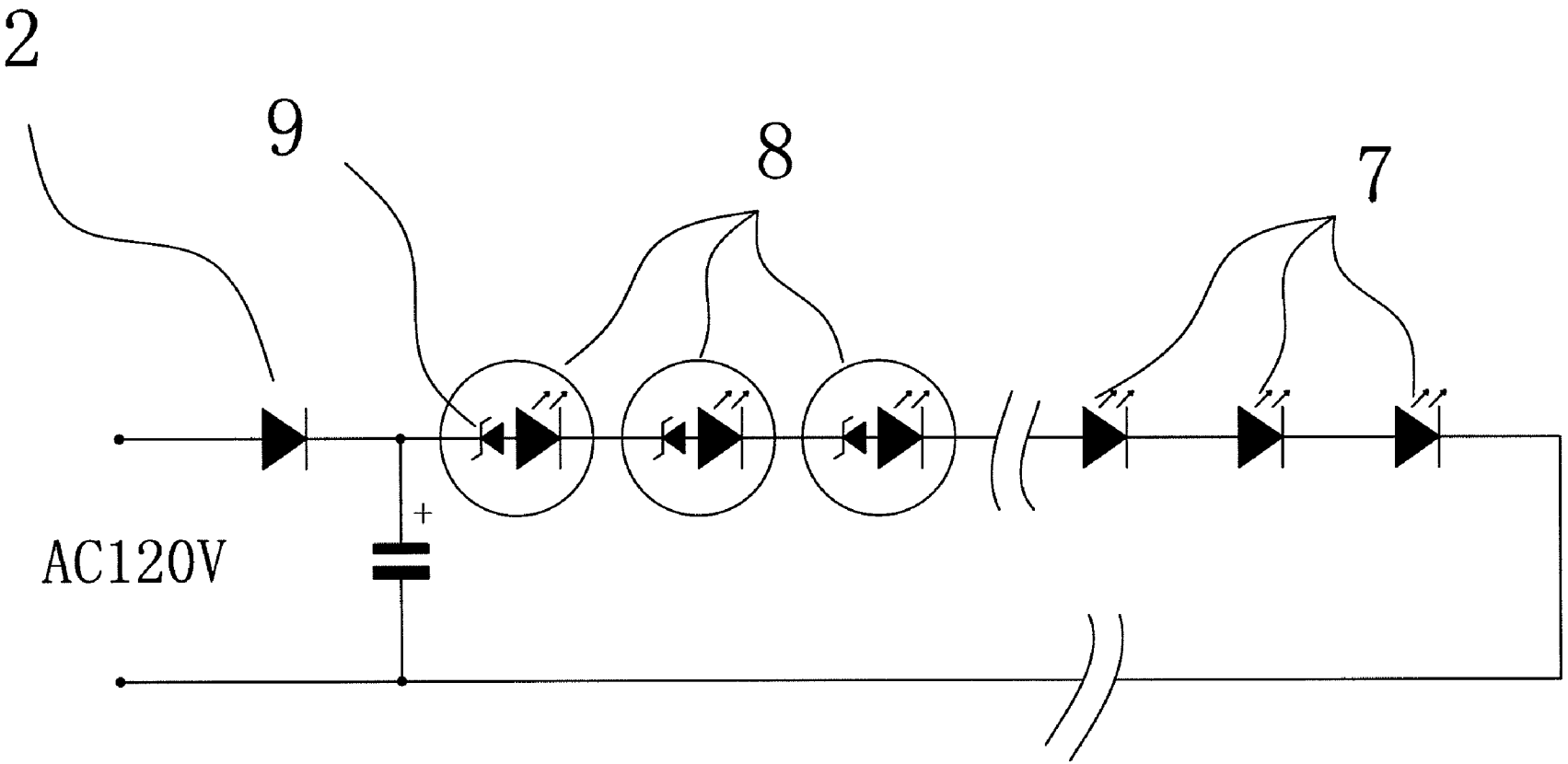
FIG. 13 is a circuit diagram of a third preferred embodiment of the LED light string of FIG. 10.

Referring to FIG. 13, it shows a circuit diagram of a third preferred embodiment of the LED light string of FIG. 10. The characteristics of the third preferred embodiment are detailed below. The rectifier 2 is a half-wave rectifier having a capacitor parallel connected with the load (i.e., the LED bulbs 8 and the LEDs 7) as that shown in FIG. 7, the LED bulbs 8 are that shown in FIG. 8, the white LED 7 is of 3.0V 0.02 A, the white LED bulb 8 is of 13.0V 0.02 A, the number of the white LEDs 7 is 27, the number of the white LED bulbs 8 is 3, AC power source is AC 120V, and operating voltage of the light string is DC 120V. It is envisaged by the invention that the light string can operate normally by wiring as above.

Figure 15:
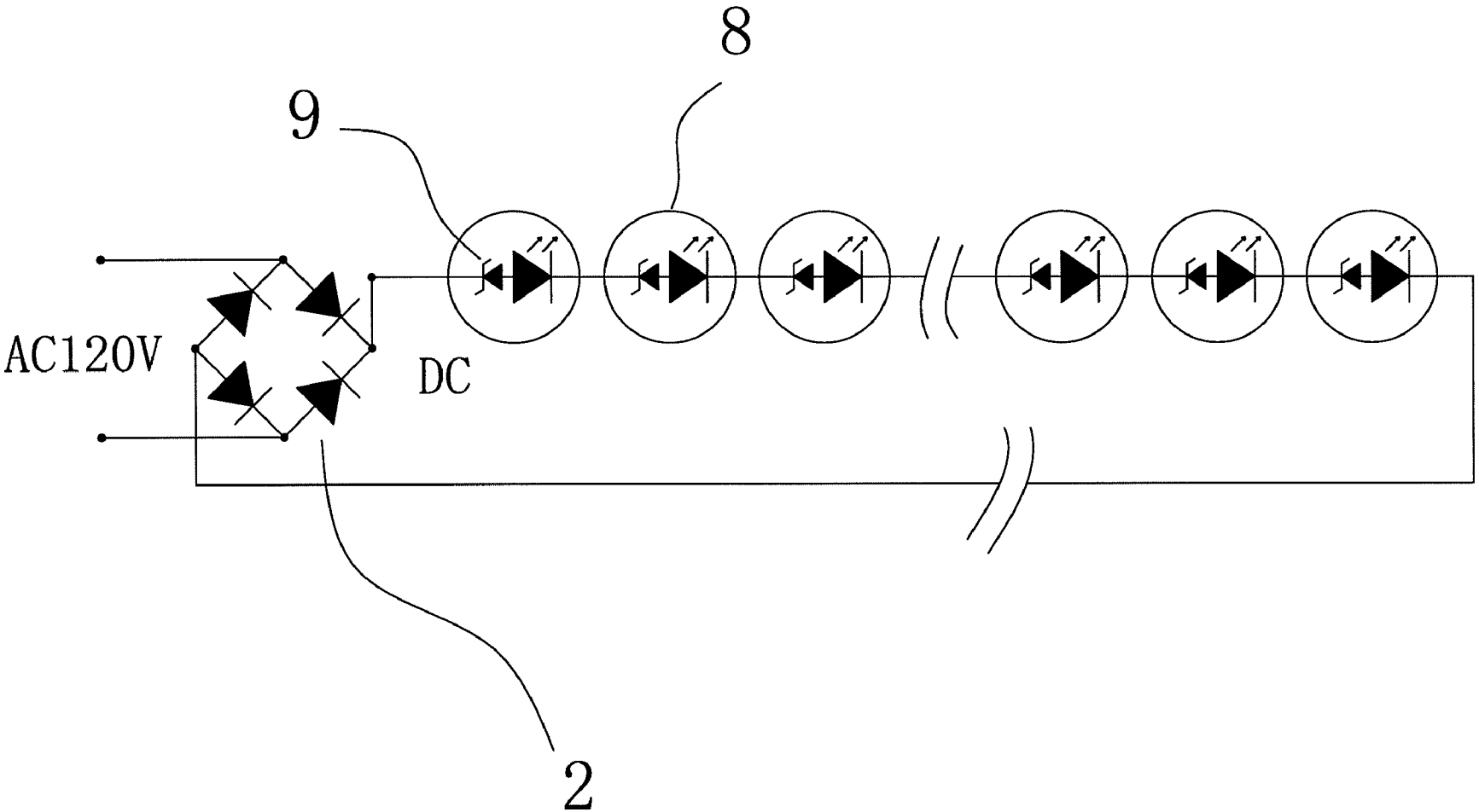
FIG. 15 is a circuit diagram of a fourth preferred embodiment of the LED light string of FIG. 10.

Referring to FIG. 15, it shows a circuit diagram of a fourth preferred embodiment of the LED light string of FIG. 10. The characteristics of the fourth preferred embodiment are detailed below. The rectifier 2 is a bridge rectifier as that shown in FIG. 5, the LED bulbs 8 are that shown in FIG. 8, the typical LEDs are eliminated, the blue LED bulb 8 is of 10V 0.02 A, the number of the blue LED bulbs 8 is 12, AC power source is AC 120V, and operating voltage of the light string is DC 120V. It is envisaged by the invention that the light string can operate normally by wiring as above.

Figure 16:
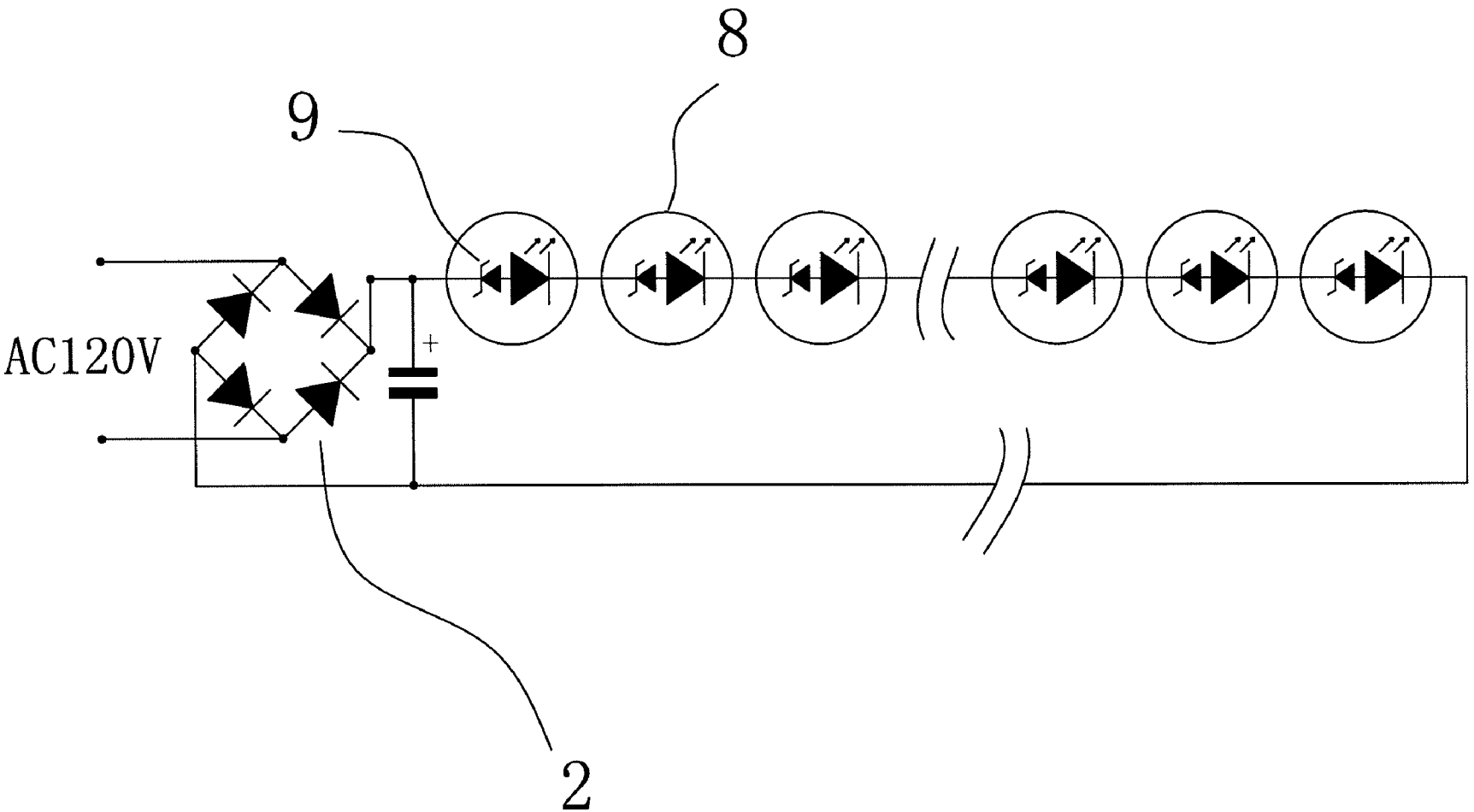
FIG. 16 is a circuit diagram of a fifth preferred embodiment of the LED light string of FIG. 10.

Referring to FIG. 16, it shows a circuit diagram of a fifth preferred embodiment of the LED light string of FIG. 10. The characteristics of the fifth preferred embodiment are detailed below. The rectifier 2 is a bridge rectifier having a capacitor parallel connected with the load (i.e., the LED bulbs 8) as that shown in FIG. 6, the LED bulbs 8 are that shown in FIG. 8, the typical LEDs are eliminated, the white LED bulb 8 is of 8V 0.02 A, the number of the white LED bulbs 8 is 15, AC power source is AC 120V, and operating voltage of the light string is DC 120V. It is envisaged by the invention that the light string can operate normally by wiring as above.

Figure 17:
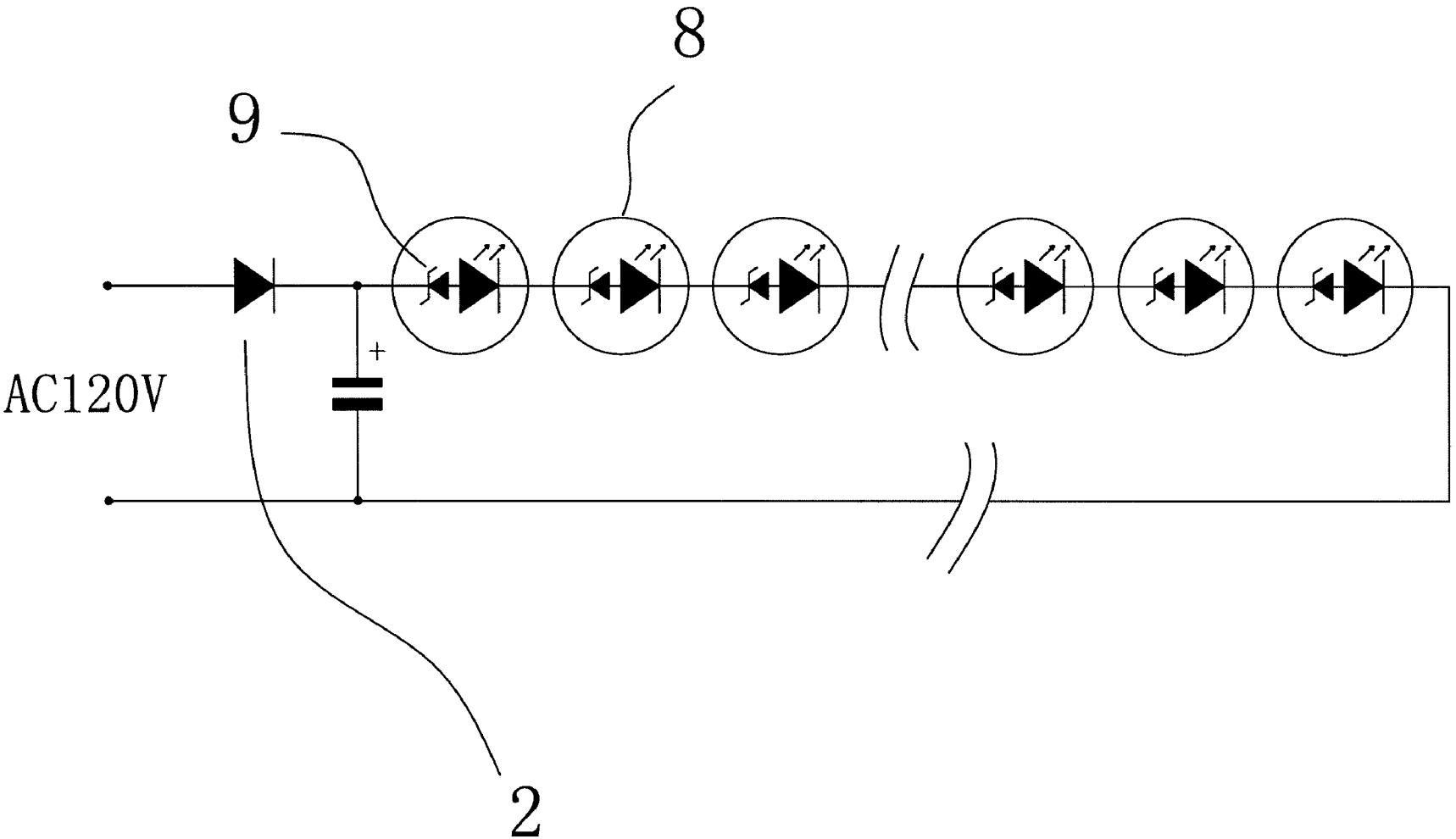
FIG. 17 is a circuit diagram of a sixth preferred embodiment of the LED light string of FIG. 10.

Referring to FIG. 17, it shows a circuit diagram of a sixth preferred embodiment of the LED light string of FIG. 10. The characteristics of the sixth preferred embodiment are detailed below. The rectifier 2 is a half-wave rectifier having a capacitor parallel connected with the load (i.e., the LED bulbs 8) as that shown in FIG. 7, the LED bulbs 8 are that shown in FIG. 8, the typical LEDs are eliminated, the red LED bulb 8 is of 6V 0.02 A, the number of the red LED bulbs 8 is 20, AC power source is AC 120V, and operating voltage of the light string is DC 120V. It is envisaged by the invention that the light string can operate normally by wiring as above.

Figure 18:
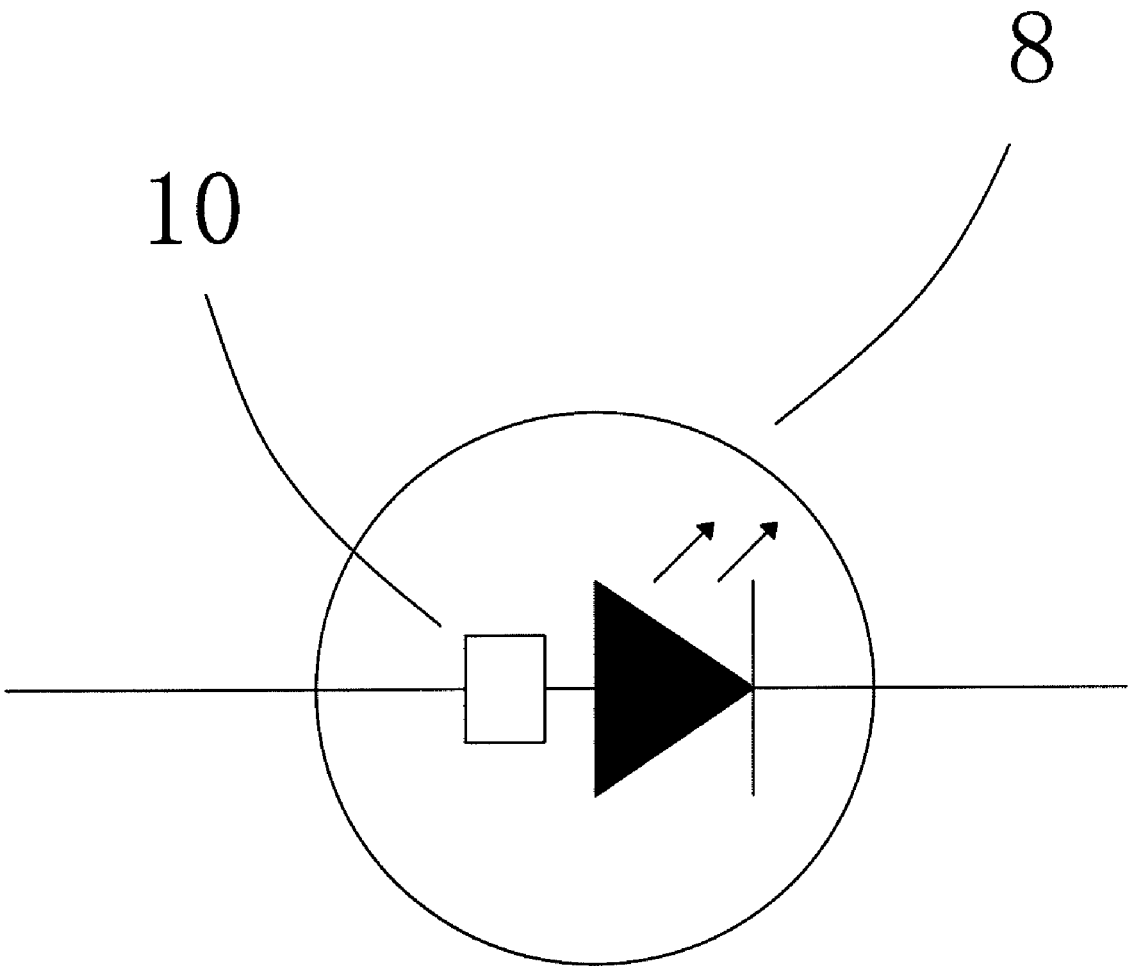
FIG. 18 is a circuit diagram of a third preferred embodiment of LED bulb according to the invention to be used in an LED light string of the invention.

Referring to FIG. 18, it shows a circuit diagram of a third preferred embodiment of LED bulb according to the invention to be used in an LED light string of the invention. The LED bulb 8 comprises a resistor 10 and an LED (not numbered) connected in series therewith. Negative electrode (i.e., cathode) of the LED is negative terminal of the LED bulb 8.

For example, the resistor 10 has a resistance of 400•, the forward voltage of the LED is 3.2V, and current flowing through both the LED and the resistor 10 is 0.02 A. Hence, the voltage component of the resistor 10 is 8.0V (i.e., 400•×0.02 A). The operating voltage of the LED bulb 8 is 11.2V (i.e., 8V+3.2V). That is, the resistor 8 may light by applying DC 11.2V thereto.

Figure 19:
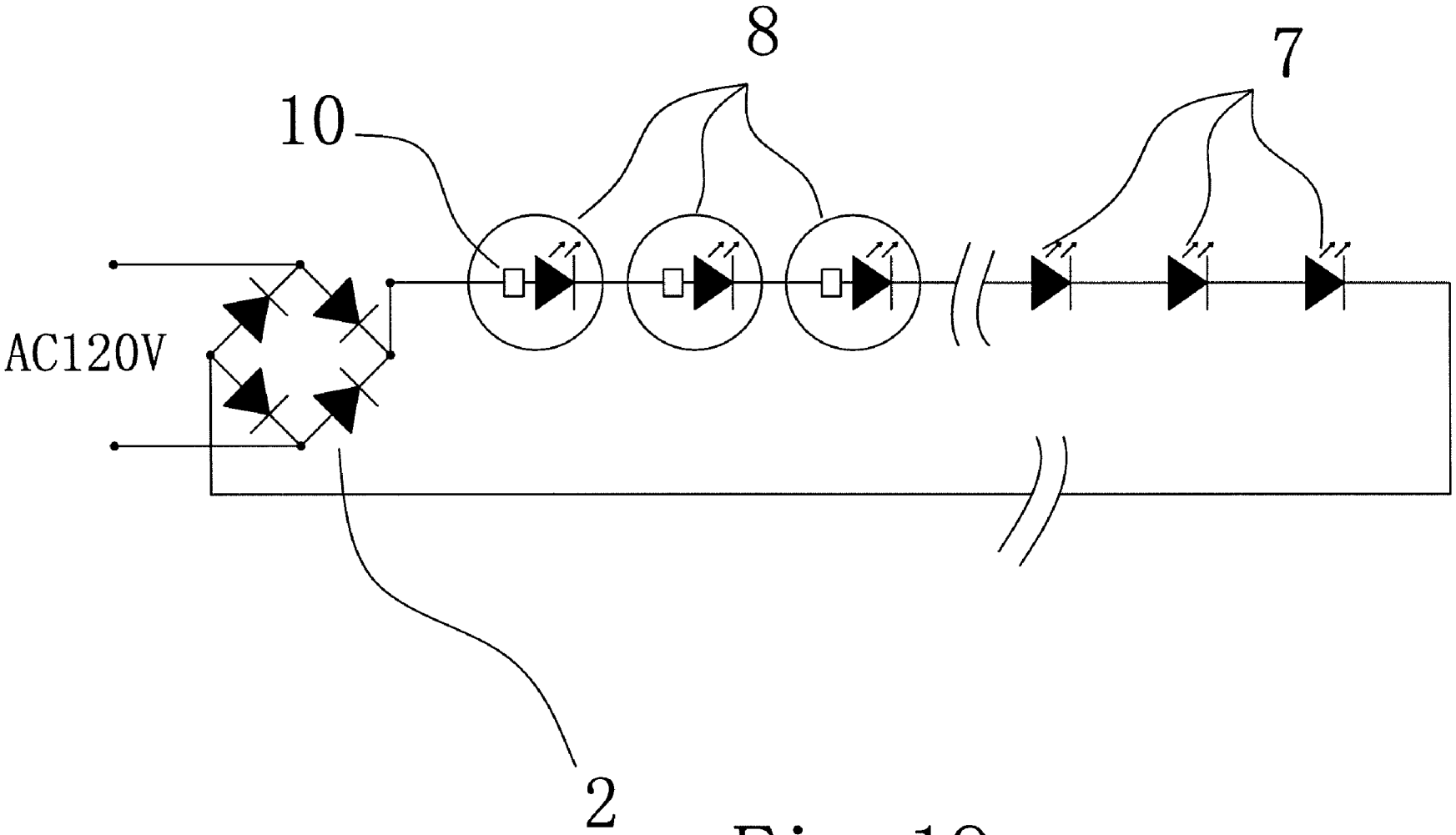
FIG. 19 is a circuit diagram of a seventh preferred embodiment of the LED light string of FIG. 10.

Referring to FIG. 19, it shows a circuit diagram of a seventh preferred embodiment of the LED light string of FIG. 10. The characteristics of the seventh preferred embodiment are detailed below. The rectifier 2 is a bridge rectifier as that shown in FIG. 5, the LED bulbs 8 are that shown in FIG. 18, the blue LED 7 is of 3.0V 0.02 A, the blue LED bulb 8 is of 13.0V 0.02 A, the number of the blue LEDs 7 is 27, the number of the blue LED bulbs 8 is 3, AC power source is AC 120V, and operating voltage of the light string is DC 120V. It is envisaged by the invention that the light string can operate normally by wiring as above.

Figure 20:
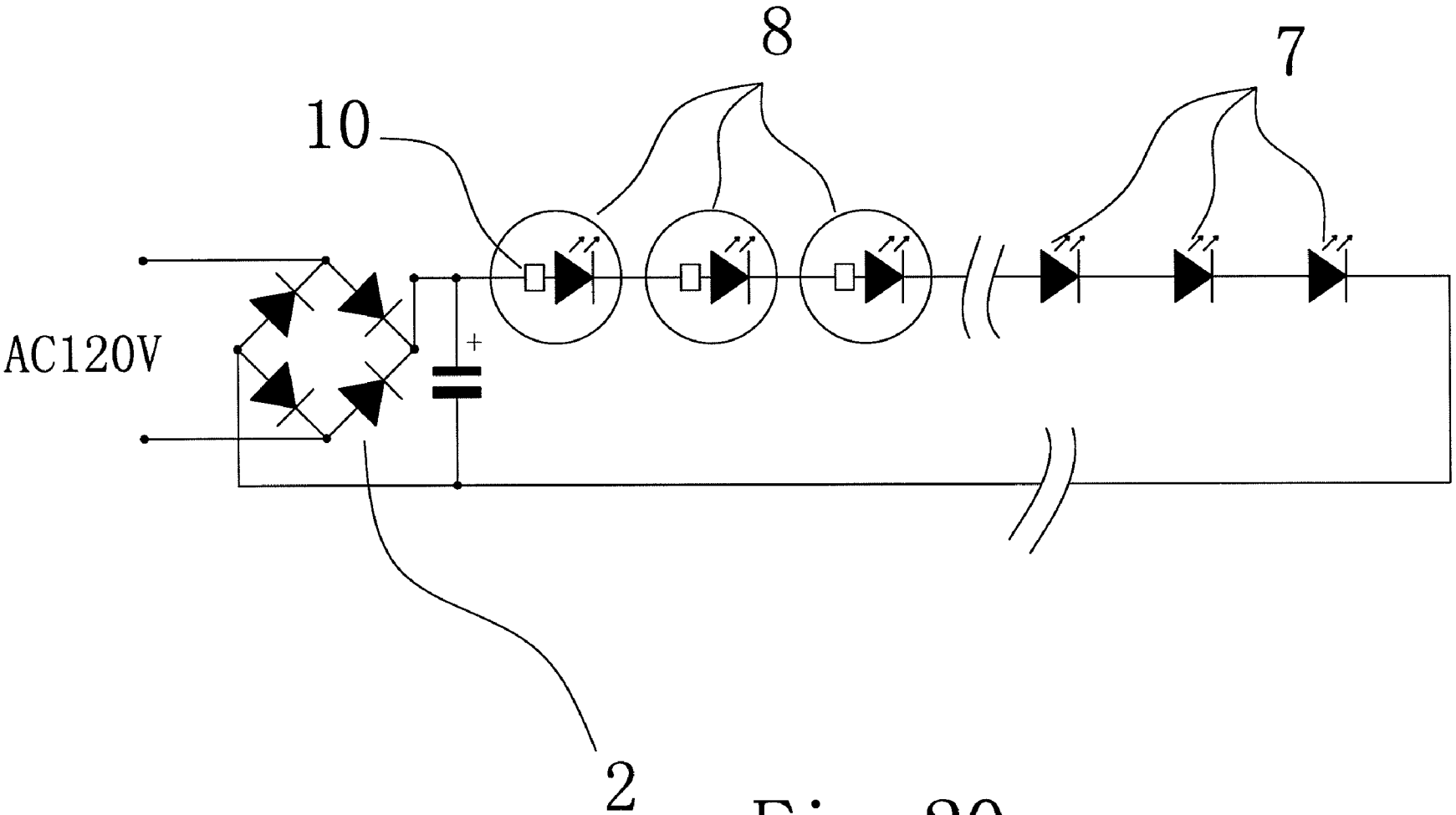
FIG. 20 is a circuit diagram of an eighth preferred embodiment of the LED light string of FIG. 10.

Referring to FIG. 20, it shows a circuit diagram of an eighth preferred embodiment of the LED light string of FIG. 10. The characteristics of the eighth preferred embodiment are detailed below. The rectifier 2 is a bridge rectifier having a capacitor parallel connected with the load (i.e., the LED bulbs 8 and the LEDs 7) as that shown in FIG. 6, the LED bulbs 8 are that shown in FIG. 18, the white LED 7 is of 3.0V 0.02 A, the white LED bulb 8 is of 13.0V 0.02 A, the number of the white LEDs 7 is 27, the number of the white LED bulbs 8 is 3, AC power source is AC 120V, and operating voltage of the light string is DC 120V. It is envisaged by the invention that the light string can operate normally by wiring as above.

Figure 21:
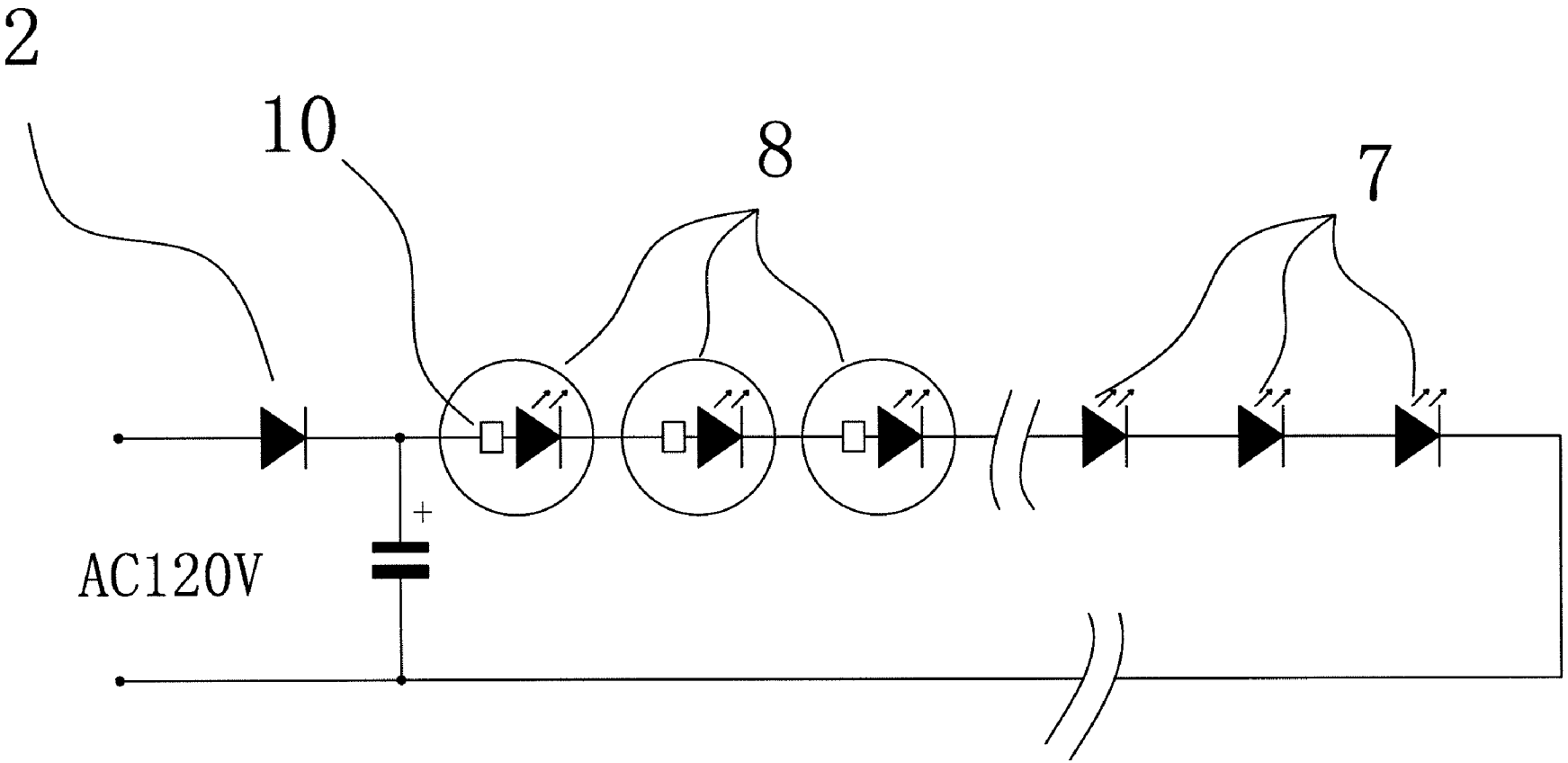
FIG. 21 is a circuit diagram of a ninth preferred embodiment of the LED light string of FIG. 10.

Referring to FIG. 21, it shows a circuit diagram of a ninth preferred embodiment of the LED light string of FIG. 10. The characteristics of the ninth preferred embodiment are detailed below. The rectifier 2 is a half-wave rectifier having a capacitor parallel connected with the load (i.e., the LED bulbs 8 and the LEDs 7) as that shown in FIG. 7, the LED bulbs 8 are that shown in FIG. 18, the white LED 7 is of 3.0V 0.02 A, the white LED bulb 8 is of 13.0V 0.02 A, the number of the white LEDs 7 is 27, the number of the white LED bulbs 8 is 3, AC power source is AC 120V, and operating voltage of the light string is DC 120V. It is envisaged by the invention that the light string can operate normally by wiring as above.

Figure 22:
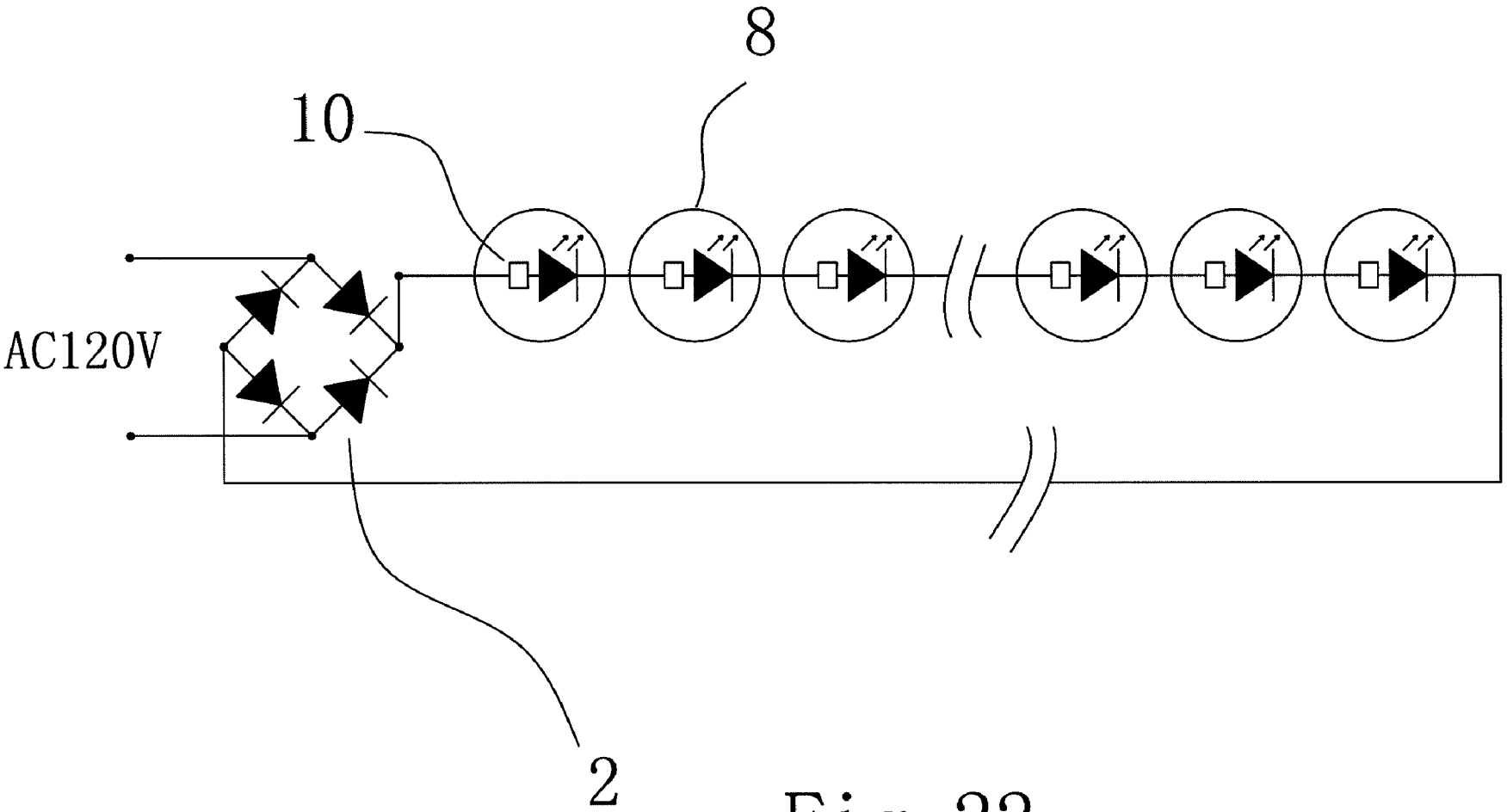
FIG. 22 is a circuit diagram of a tenth preferred embodiment of the LED light string of FIG. 10.

Referring to FIG. 22, it shows a circuit diagram of a tenth preferred embodiment of the LED light string of FIG. 10. The characteristics of the tenth preferred embodiment are detailed below. The rectifier 2 is a bridge rectifier as that shown in FIG. 5, the LED bulbs 8 are that shown in FIG. 18, the typical LEDs are eliminated, the blue LED bulb 8 is of 10V 0.02A, the number of the blue LED bulbs 8 is 12, AC power source is AC 120V, and operating voltage of the light string is DC 120V. It is envisaged by the invention that the light string can operate normally by wiring as above.

Figure 23:
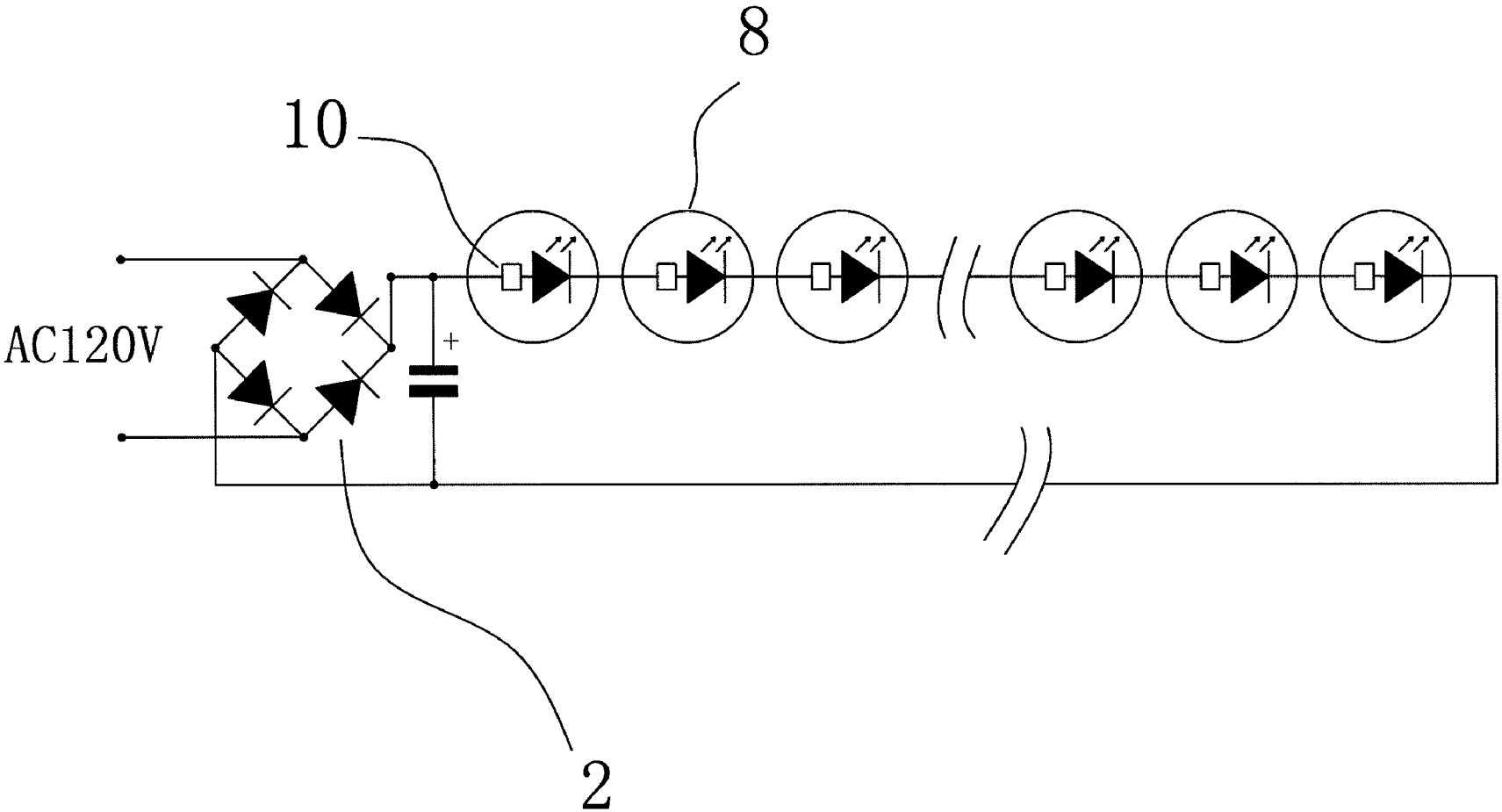
FIG. 23 is a circuit diagram of an eleventh preferred embodiment of the LED light string of FIG. 10.

Referring to FIG. 23, it shows a circuit diagram of an eleventh preferred embodiment of the LED light string of FIG. 10. The characteristics of the eleventh preferred embodiment are detailed below. The rectifier 2 is a bridge rectifier having a capacitor parallel connected with the load (i.e., the LED bulbs 8) as that shown in FIG. 6, the LED bulbs 8 are that shown in FIG. 18, the typical LEDs are eliminated, the white LED bulb 8 is of 8V 0.02 A, the number of the white LED bulbs 8 is 15, AC power source is AC 120V, and operating voltage of the light string is DC 120V. It is envisaged by the invention that the light string can operate normally by wiring as above.

Figure 24:
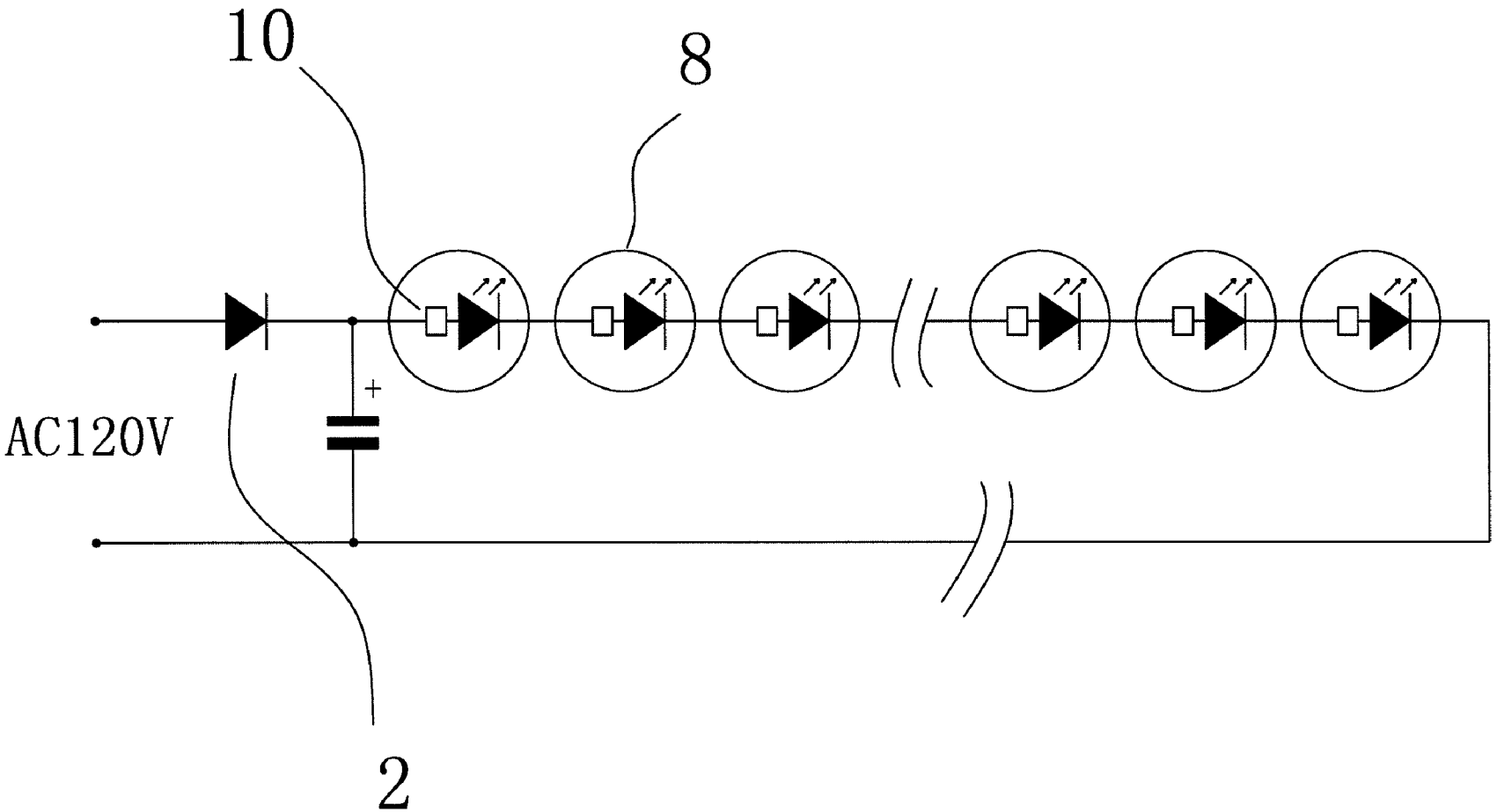
FIG. 24 is a circuit diagram of a twelfth preferred embodiment of the LED light string of FIG. 10.

Referring to FIG. 24 it shows a circuit diagram of a twelfth preferred embodiment of the LED light string of FIG. 10. The characteristics of the twelfth preferred embodiment are detailed below. The rectifier 2 is a half-wave rectifier having a capacitor parallel connected with the load (i.e., the LED bulbs 8) as that shown in FIG. 7, the LED bulbs 8 are that shown in FIG. 18, the typical LEDs are eliminated, the red LED bulb 8 is of 6V 0.02 A, the number of the red LED bulbs 8 is 20, AC power source is AC 120V, and operating voltage of the light string is DC 120V. It is envisaged by the invention that the light string can operate normally by wiring as above.

While the invention herein disclosed has been described by means of specific embodiments, numerous modifications and variations could be made thereto by those skilled in the art without departing from the scope and spirit of the invention set forth in the claims.

What is claimed is:

1. An electrical circuit for use as a string of lights, comprising:

a rectifier for converting AC (alternating current) into DC (direct current); and a plurality of lamps connected in series, each lamp having an LED, wherein at least one of the lamps has a Zener diode connected in series with the LED, a positive terminal of the lamp proximate the rectifier is connected to a positive terminal of an output of the rectifier, and a negative terminal of the lamp distal the rectifier is connected to a negative terminal of the output of the rectifier; and wherein an anode of the Zener diode of each lamp is connected to an anode of the LED thereof.

* * * * *